US005916076A

United States Patent [19]

Cittadini et al.

[11] Patent Number: 5,916,076

[45] **Date of Patent: *Jun. 29, 1999**

[54] PLASTICS STRUCTURAL SHAPE FOR REFRIGERATOR CABINETS

[75] Inventors: Paolo Cittadini, Luvinate; Adriano Merla, Angera, both of Italy

[73] Assignee: Industrie Ilpea S.p.A., Malgesso, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/760,068

[22] Filed: Dec. 4, 1996

[30] Foreign Application Priority Data

Jan. 15, 1996 [IT] Italy ..... MI96A0046

[51] Int. Cl.[6] ..... E06B 7/16

[52] U.S. Cl. ..... 49/492.1; 49/475.1; 49/478.1

[58] Field of Search ..... 49/475.1, 482.1, 49/492.1, 493.1, 478.1

[56] References Cited

U.S. PATENT DOCUMENTS 3,137,900 6/1964 Carbary ..... 49/492.1 X
3,226,367 12/1965 Monti ..... 49/492.1 X
3,378,957 4/1968 Frehse ..... 49/492.1 X
4,617,759 10/1986 Pasqualini et al. ..... 49/492.1 X
5,193,310 3/1993 Kiel ..... 49/493.1 X

FOREIGN PATENT DOCUMENTS 319087 6/1989 European Pat. Off. ..... 49/492.1

*Primary Examiner*—Jerry Redman
*Attorney, Agent, or Firm*—Foley & Lardner

[57] ABSTRACT

The invention provides a plastics structural shape for refrigerator cabinets provided with a door and a door liner comprising a bellows gasket portion forming a seal between the door and the cabinet box part, the structural shape and the gasket portion being joined together or being integral with each other by being co-extruded from two materials having different rigidities so that the gasket portion can be easily detached from the structural shape when necessary along the region in which they are joined together, said structural shape having a channel arranged to receive a replacement bellows gasket portion, and at least one elastically yieldable lateral flange acting as a spring clip for snap-fitting the structural shape to the door liner, characterised in that within said structural shape said channel is defined by a pair of walls which extend vertically or obliquely from a base which when in its coupled operating position overlies the door and door liner along their joining line.

13 Claims, 5 Drawing Sheets

PLASTICS STRUCTURAL SHAPE FOR REFRIGERATOR CABINETS

BACKGROUND OF THE INVENTION

In European patent 0 146 994 the present applicant describes a plastics structural shape for refrigerators and the like provided with a door and door liner, the structural shape comprising a bellows gasket portion which forms the seal between the door and the cabinet box part, the structural shape and the gasket portion being joined together for example by coextruding two materials of different rigidity, such as to allow instant detachment of the gasket portion which is constructed of less rigid material than that of the structural shape, said structural shape having on that side which when in operation faces the box part a pair of lateral faces between which there is defined a channel able to receive a replacement bellows gasket portion.

The structural shape has at least one elastically yieldable lateral flange which acts as a spring clip to allow the structural shape to be snap-fitted to the door liner.

European patent 0 319 087 of the present applicant describes a structural shape of this kind in which inter alia in said elastically yieldable flange its fulcrum is formed by an elbow insert of soft material for example coextruded with the more rigid constituent material of said flange of the structural shape. Because of the basic characteristic of providing a snap-fitted element, the aforesaid patents have essentially resulted in the technical innovation of enabling bonded frames formed from four pieces of said structural shape to be snap-mounted in automatic systems, for example robotized.

SUMMARY OF THE INVENTION the present invention proposes a structural shape of the aforesaid type comprising certain improvements over the original structural shapes. These improvements are required in particular with regard to certain aspects of the technology in question, which are briefly discussed below.

A first aspect for which the present invention provides an improvement in the technology in question relates to the fact that once the connection between the door and the door liner has been made, these structural shapes have also to constitute a sealing system for the subsequent foaming of the thermoinsulating filling material injected between the door and door liner, for example expanded polyurethane.

As this injection of expanded material results in a high pressure which tends to urge the structural shape fitted between the door and door liner outwards, during the foaming a mould and counter-mould system must be used to oppose the pressure resulting from the insulating material injection.

A drawback of the structural shapes of the two aforesaid European patents relates to the fact that under the action of this mould and counter-mould, particularly the soft part of the structural shape consisting of the bellows gasket becomes squeezed during the foaming operation. This squeezing results in deformation which can be permanent, because it partially reduces the design height of the structural shape, and when the door is later fixed to the cabinet box part, on that side of the rotation where the distance between the door and box part is fixed—determined by the hinges—the structural shape is unable to form a seal.

To restore normal height the structural shape must be exposed to a hot air blower, a lengthy and delicate operation which must be carried out before packaging the refrigerator.

These problems, which normally arise with traditional non-extruded gaskets, are well known in this sector.

there is hence a requirement to limit to a minimum this deformation arising by squeezing during foaming. Another kind of problem arises in rigid structural shapes of the aforesaid type, related to the fact that with this type of structural shape, the tolerance allowed during the bonding of the pieces to form the frame to be mounted is generally much smaller than in the case of gaskets formed entirely of soft material. For example, while tolerances of between 4 and 6 mm are possible with these latter, in the rigid material structural shapes discussed in the present description the allowable bonding tolerances are only ±1 mm.

Another problem of a still different kind is related to the fact that in the structural shapes of the aforesaid European patents the connection region between the rigid and soft part is exposed to view.

Although the rigid material can be coloured to make it as similar as possible to the soft material, the different nature of the two materials is such that the colour difference between them is visible, if for no other reason than the different appearance of the rigid surface compared with the soft surface.

For obvious reasons of refrigerator aesthetics, it would however be desirable to achieve the same colour and surface appearance for the exposed part of the structural shape.

A further aspect of a different kind which can result in problems during the installation of the said structural shapes is related to the fact that there is currently achieving success on the market a type of cabinet in which to create an aesthetic continuity between the box part and the door, this latter is shaped with a shoulder projecting along the entire outer perimeter of the door such as to conceal the region in which the structural shape is fitted to the door.

Considering in particular the structural shape of said European patent 0 319 087, in which the replacement soft gasket is designed to be drawn over the rigid structural shape laterally, ie precisely on that side on which in the aforesaid recent technology the shoulder is formed along the door perimeter, the present of this shoulder would make the lateral introduction of the replacement soft gasket absolutely problematical.

Another drawback of a different kind, particularly in the case of the structural shape of said European patent 0 146 994, is due to the fact that the cross-section of this structural shape is rather wide, such as to define a considerable interspace between the outer line of the structural shape and the door liner, this interspace being reduced in the subsequent structural shape of European patent 0 319 087.

In accordance with the objects of the present invention, it would therefore be desirable to provide a structural shape of the type herein discussed in which the problem of the too large distance between the structural shape exterior and the door liner due to the wide cross-section of the first structural shape is eliminated, while at the same time overcoming the problem of easily inserting the replacement soft gasket notwithstanding the presence of the shoulder provided for appearance reasons on the door in accordance with recent techniques, and which as seen heretofore is difficulty adaptable to a structural shape of the type described in European patent 0 319 087.

A further improvement offered by the structural shape of the present invention relates to the drawback deriving from the fact that known structural shapes tend, particularly in the central part of the horizontal sides of a refrigerator, to undergo a certain deformation due to the gasket weight, hence a gravity deformation which is accentuated in the central part of the horizontal sides, ie in moving away from the regions in which these are bonded to the vertical sides, at which this gravity deformation is naturally much less pronounced.

A further drawback overcome by the present invention is due to the fact that the door liner, constructed generally from a thermoformed plastics sheet such as polystyrene, tends to be produced in increasingly smaller thicknesses. For example, door liners consisting of a thermoformed sheet of just 1 mm thickness have recently commenced production. It will therefore be apparent that, given this small thickness, the flange acting as the spring clip for snap-fitting the said structural shapes is able to apply a very large lateral thrust to the door liner to the extent of deforming it, for example by warping it.

A further object of the present invention is therefore to overcome this drawback.

It has now been surprising found, according to the present invention, that all the aforesaid drawbacks of the known structural shapes described in the aforesaid prior art can be jointly overcome by a plastics structural shape for refrigerator cabinets and the like provided with a door and a door liner comprising a bellows gasket portion forming a seal between the door and the cabinet box part, the structural shape and the gasket portion being joined together or being integral with each other by being co-extruded from two materials having different rigidities so that the gasket portion can be easily detached from the structural shape when necessary along the region in which they are joined together, said structural shape having a channel arranged to receive a replacement bellows gasket portion, and at least one elastically yieldable lateral flange acting as a spring clip for snap-fitting the structural shape to the door liner, characterised in that within said structural shape said channel is defined by a pair of walls which extend vertically or obliquely from a base which when in its coupled operating position overlies the door and door liner along their joining line.

BRIEF DESCRIPTION OF THE DRAWINGS

The characteristics and advantages of the invention will be more apparent from the description of one embodiment thereof given hereinafter by way on non-limiting example with reference to the figures of the accompanying drawings, in which.

DETAILED DESCRIPTION OF THE PREFERRED EMBODIMENT

Figure 1:
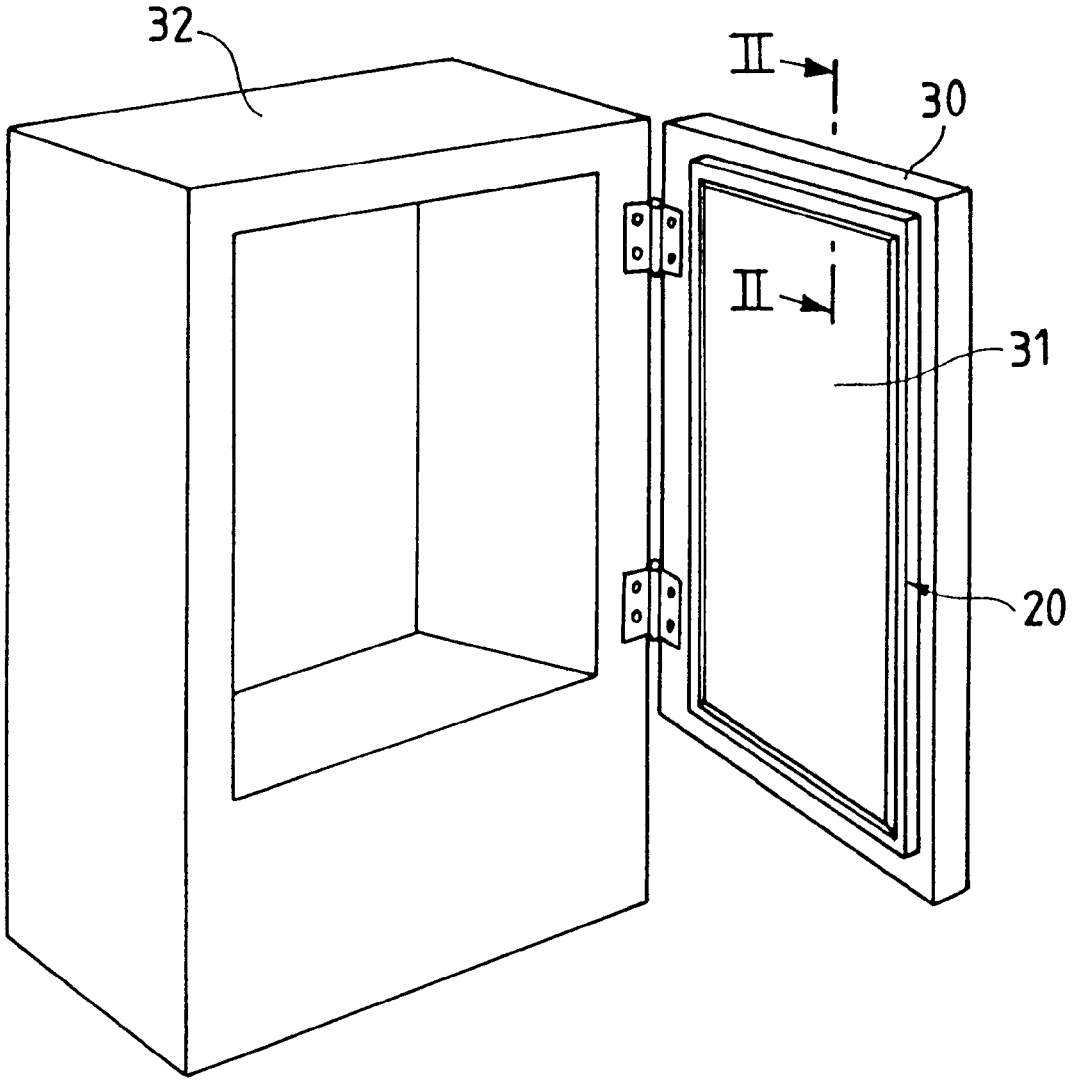
FIG. 1 is a schematic perspective view of a refrigerator cabinet provided with a door and door liner to which the structural shape of the present invention is applied.

With reference to the figures, a structural shape 1 of the invention operationally mounted between a door 30 and a door liner 31 is of complex cross-section having, on that side which when in the operation position (FIG. 2) faces the box part 32 of a refrigerator cabinet, a substantially flat base 3 extending along slightly offset planes. It terminates laterally with a seal strip 15 and at the other end with a seal strip 4, both these strips being of soft material, coextruded with the rigid material of the structural shape. In an intermediate position the cross-section of the structural shape 1 assumes an irregular T shape by the effect of a central rib 18 extending vertically in the opposite direction to the box part 32 to assume a configuration slightly angled towards the interior. From the end of said rib 18 there extends a lateral flange 7 elastically yieldable in the manner of a spring clip about a fulcrum 8 formed by a soft material insert coextruded with the rigid material of the structural shape. Said insert does not coincide with the elbow of the spring clip but instead is positioned immediately above it along the flange 7, hence having a rectilinear form when in its rest position (FIG. 2, dashed line 7'), and not curved as instead is the case of the structural shape of European patent 0 319 087. The lateral flange 7 terminates with a groove 19 of substantially C cross-section, terminating with a tooth 41 suitable for coupling to the door liner 31.

Figure 5:
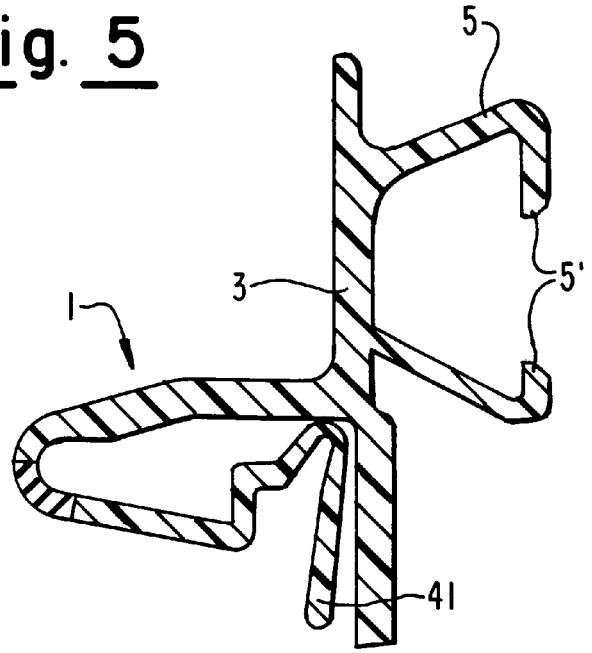
FIG. 5 illustrates one embodiment of a structural shape having walls 5 which are oblique and diverging (the angle of inclination may vary in other embodiments)
Figure 6:
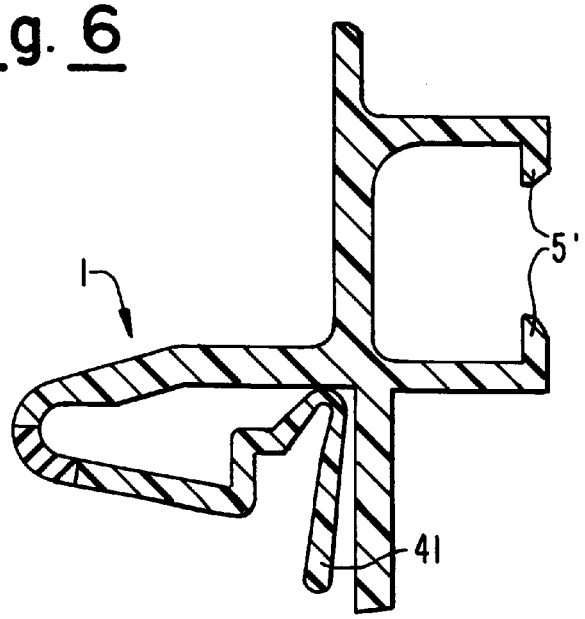
FIG. 6 illustrates a structural shape having vertical walls 5 which are not inclined.

On the opposite side of the structural shape, namely that which when in the operating position faces the cabinet box part, from the base 3 there extend in a substantially vertical direction a pair of walls 5 terminating with a flanged edge 5', and between which a channel 23 is hence defined. In the embodiment shown in FIG. 2, the vertical walls 5 are also slightly inclined in the same direction, so as to be oblique and parallel. These could also be oblique but diverging, (see FIG. 6) or be not inclined (see FIG. 5). In the coupled operating position shown by full lines in FIG. 2, the base 3 of the structural shape overlies the door and door liner, against which it seals by means of the strips 4 and 15 respectively. The walls 5 extend from the base to a distance d from an inner edge 43 of the door liner 31 which is greater than one half of a distance D from the inner edge 43 of the door liner 31 to an outer edge 42 of the door liner 31. The structural shape 1 is constructed of rigid plastics, for example polyvinylchloride, which is extruded, cut and bonded at its corners to form a frame which reproduces the perimeter of the door of the refrigerator cabinet to which it is applied.

A gasket 20, for example of soft plasticized PVC, is coextruded with the structural shape 1 in a single piece.

The gasket 20 has a tubular cross-section defining an extensible chamber 21 acting as a bellows, and an upper chamber 24 to the side of a seat 22 for receiving a bar of magnetic material. The inner lateral wall 6 of the gasket 20 is integral with the corresponding wall 5 of the structural shape and with the outside of the base 3. The lower shape of the outer lateral wall 16 of the gasket (which wall can be suitably divided into two regions of different thickness or rigidity to give it lateral stability) is a characteristic of the described embodiment of the present invention, in that the wall 16 integrally covers the structural shape to terminate lowerly with the said strip 4 which rests against the door 30 when the pieces are assembled in their operating position, so that the structural shape 1 is no longer visible when in this position.

Figure 2:
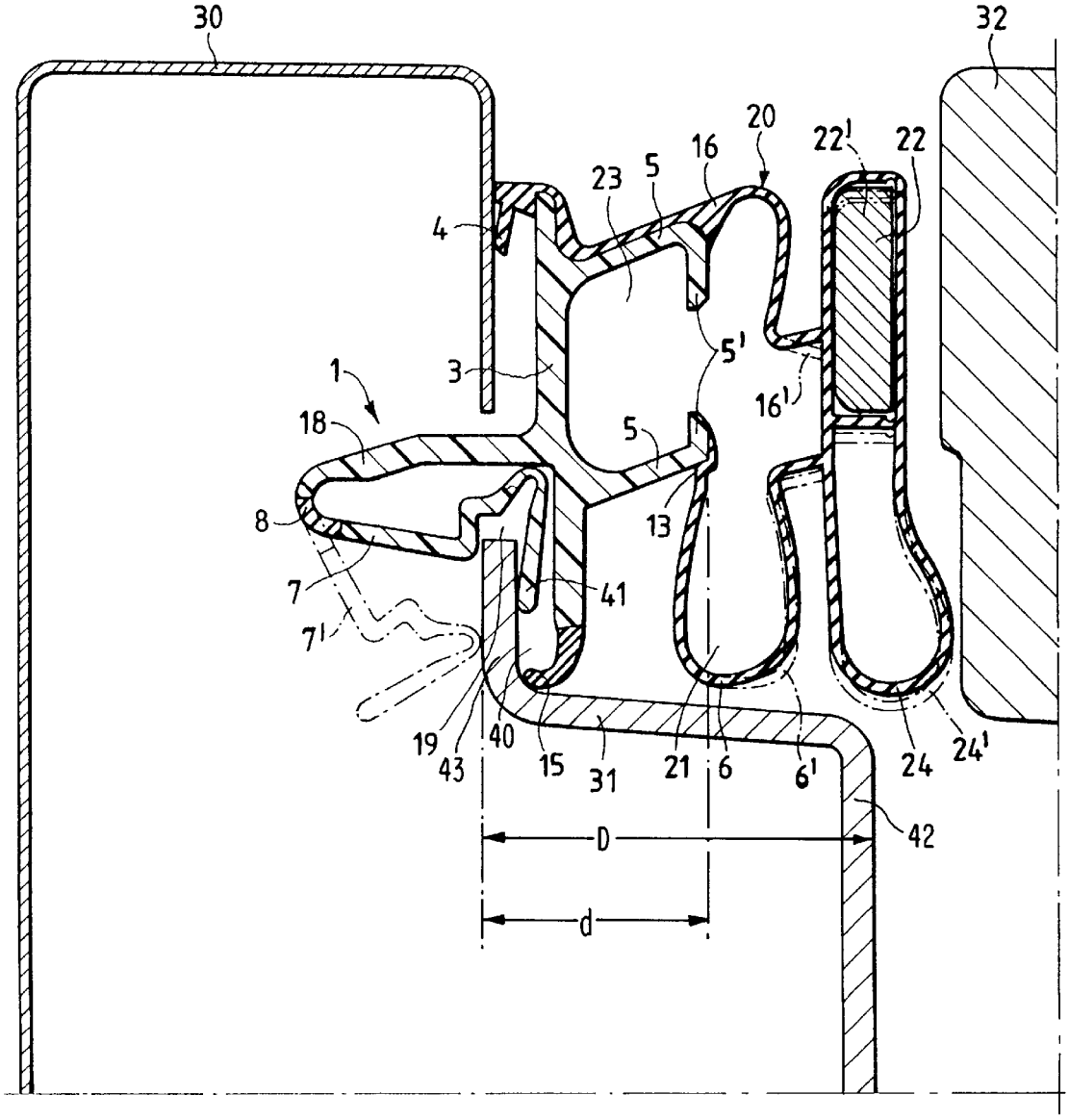
FIG. 2 is a cross-section through said structural shape in its operating position mounted on the door and door liner, the section being taken on the line II—II of FIG 1.

In FIG. 2 the reference numerals 6', 16', 22' and 24' show with dashed lines the corresponding parts, 6 16, 22 and 24 of the gasket 20 when in a position corresponding to a slight deformation of the nominal cross-section as explained hereinafter in relation to one of the advantages of the invention.

Figure 3:
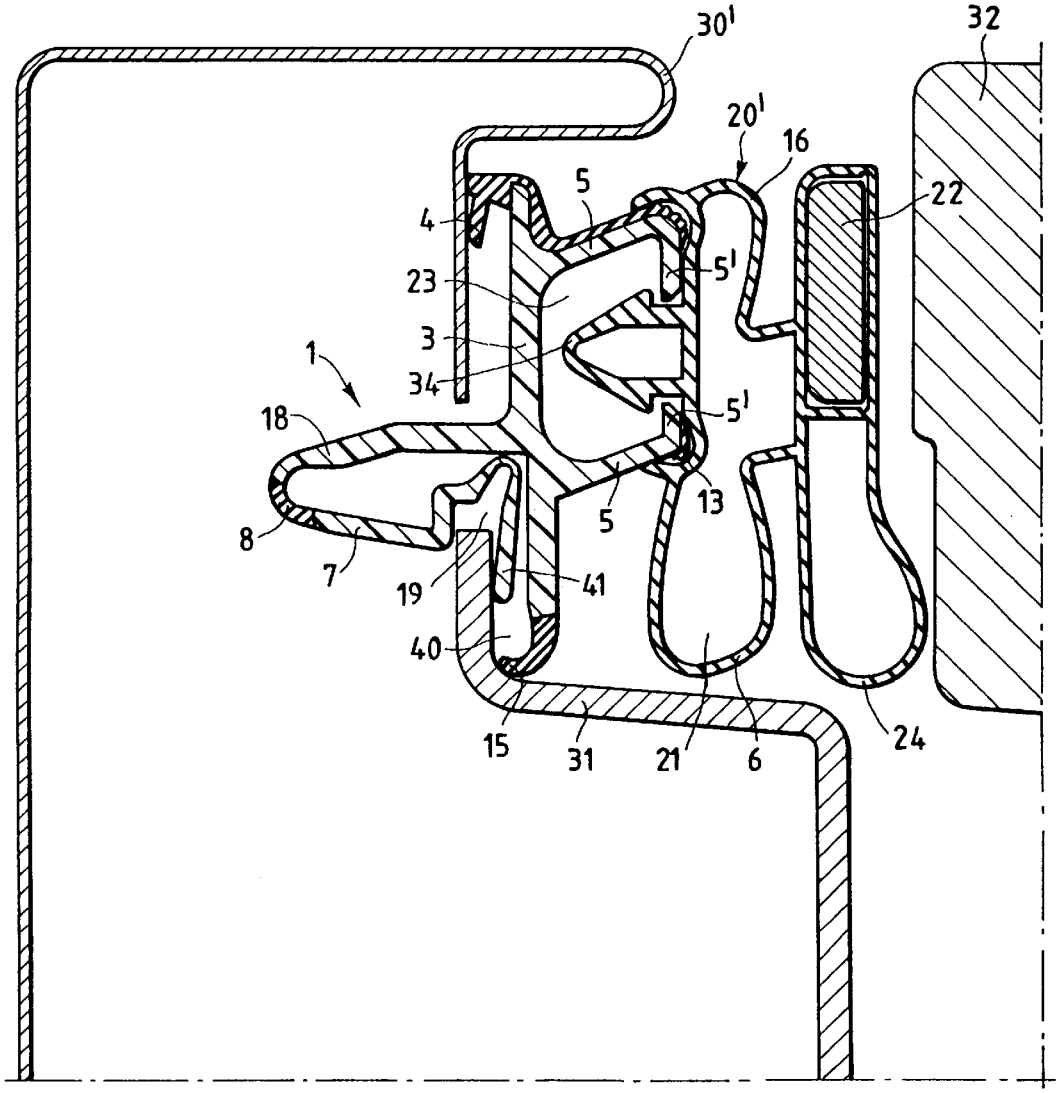
FIG. 3 is a cross-section similar to that of FIG. 2 but in a different operating position, ie with the replacement gasket mounted.

In relation to a different advantage of the invention, in FIG. 3 a modification of the door 30 is shown in which a shoulder 30' projects towards the box part in contrast to the embodiment shown in FIG. 2, so as to make the structural shape invisible when in the closed position of FIG. 3.

The seal strips 4 and 15 act as gaskets for restraining the foaming which takes place at the end to give thermoinsulating properties to the door after the pieces have been assembles. The strip 15 is shaped to form a seal by closing the distance between the base 3 of the structural shape and the door liner 31, between which there is defined an interspace 40 for the elastic return of the tooth 41 of the lateral flange 7, and for facilitating its movement of engagement against the door liner.

The seal strip 15 facilitates this movement of the lateral flange 7 because it maintains the distance between the base of the structural shape and the door liner 31, to allow free play for the tooth 41 within the interspace 40.

In the embodiment shown in the figures, levelling between the door and door liner in the final position with assembly complete is ensured by the arrangement of the base 3 of the structural shape along offset planes. In this respect the interspace 40 on the inner side of the structural shape is compensated by the lower height position of the outer part of the base 3, so reducing the distance from the door. In general it is therefore not necessary for the door and door liner to be positioned at the same level. For installation, the structural shape 1 comprising the coextruded gasket 20 is suitably arranged in the form of a frame and in this form is supplied to the manufacturer of the refrigerator cabinet, as described in the aforesaid European patents of the present applicant.

The frame formed from the structural shape 1 is made to descent, for example by a suitable mechanical arm, towards the door liner 31, suitably positioned for example on a support which clamps it. As soon as the lateral flange 7, in the initial position shown by dashed lines in FIG. 2, comes into contact with the edge of the door liner 31, it yields under the thrust of this latter and begins to bend elastically inwards, in the manner of a spring clip about its fulcrum 8, which is in fact flexible. When the yieldable lateral flange 7 has terminated its travel along the edge of the door liner 31 and this edge has reached the level of the groove 19, the flange 7 snap-operates by the effect of its elastic return and engages the edge of the door liner 31 to lock it.

The structural shape 1 and the door liner 31 hence assembled together are then rested on the door 30 (for example by a robotized system) and the entire assembly is locked by foam through the interspace between the door and door liner.

Figure 4:
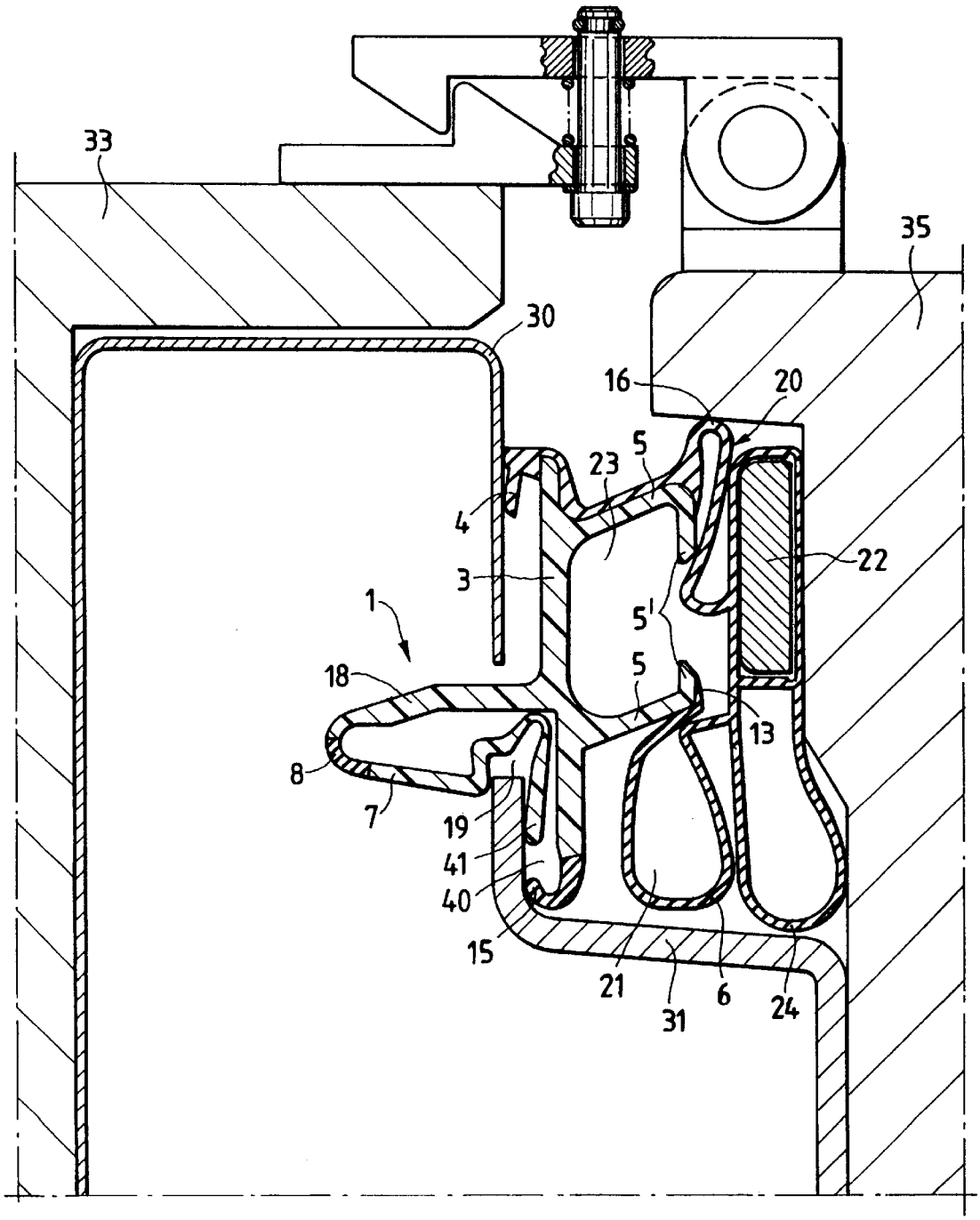
FIG. 4 is a similar cross-section through the structural shape mounted on the door and door liner during the foam filling of the cavity defined between the door and door liner.

FIG. 4 of the accompanying drawings shows the structural shape mounted on the door and door liner in cooperation with a foaming mould 33 and counter-mould 35.

This is positioned above the door and door liner on which the frame formed from the structural shape of the invention has been mounted, so as to provide an adequate back pressure against the pressure of the foaming material injected into the interspace defined between the door and door liner for thermal insulation purposes.

From FIG. 4 a further advantage of the present invention can be deduced.

In this respect it can be seen that the structure of the structural shape 1 with walls 5 extending vertically towards the counter-mould 35 means that this latter does not have to extend towards the structural shape, so preventing excessive squeezing of the gasket.

As can be seen the soft part forming the gasket is not squeezed between the counter-mould and the assembly formed by the mould, door and door liner, hence preventing gasket deformation which could be irreversible and hence compromise proper sealing of the door against the box part, with the need for operating off the production line for restoring the nominal height of the structural shape.

As shown in FIG. 3, when the coextruded soft gasket 20 deteriorates by wear, rapid replacement can be achieved by tearing it off at the level of the flanges 5' of the structural shape and inserting into the channel 23 a new gasket 20'. This spare gasket of soft PVC is characterised by a nosepiece 34 of wedge cross-section.

As initially stated, the invention achieves various advantages under different aspects. These can be summarized as follows. It has been seen that the invention enables the rigid structural shape to be totally covered with the soft gasket. This represents a technical improvement in that as the rigid structural shape is not visible, it is no longer necessary to give it the same colour and appearance as the soft gasket to prevent anti-aesthetic contrast.

These is also an economical improvement in that the rigid material is generally of lower cost, for the mere fact that it is no longer necessary to colour it.

the advantage of lesser deformation by squeezing during foaming shown in FIG. 4 has already been mentioned. It can be added that there is a reduction of about 50% in the squeezing, in part permanent, undergone by the gasket during foaming, compared with the structural shapes of the preceding patents.

Moreover, as the replacement gasket cavity is no longer provided internal to the door with door liner but external to it, there is a saving in this case.

A further advantage is due to the possibility of providing a centering hole in the rigid material of the structural shape during preparation of the pieces, hence enabling the pieces to be centered for bonding and thus respect the required tolerances (±1 mm).

A further advantage is related to the embodiment shown in FIG. 3, in which the door shoulder 30' formed in accordance with the most recent stylistic tendency (soft line) would prevent a replacement gasket being located laterally and hence make it more difficult to replace a gasket having its cavity positioned internally between the door and door liner instead of projecting outwards as in the case of the invention.

A further important advantage of the structural shape of the invention derives from the fact that the insert 8 forming the fulcrum of the spring clip 7 is no longer of elbow shape and curved when in its rest position, but instead extends from the flange and is thus rectilinear when in its rest position (dashed lines 7' in FIG. 2). In this manner the counteracting force of such a spring clip formed of rigid PVC is very small and there is hence no longer the risk of deforming the door liner which, as stated, is produced in a very small thickness.

Finally, it has been stated with reference to FIG. 2 that the nominal cross-section (taken on the line II—II of FIG. 1, ie on the horizontal side of the door) undergoes deformation (dashed lines 6', 16', 22', 24'). This however is very small in the structural shape of the present invention, and substantially less than known structural shapes, because the structure of the structural shape according to the invention with its walls 5 projecting outwards is such as to elevate the point of connection with the gasket, hence reducing the width of the cross-section of this latter, which is therefore able to withstand the weight of the magnetic strip, with virtually invisible deformation in its central part.

This drawback of gasket deformation due to gravity is however quite considerable and common in the case of normal mono-extruded gaskets.

Hence as can be seen, all the initially stated advantages are effectively attained by the structural shape of the present invention.

What is claimed is:

1. A sealing assembly for a refrigerator cabinet having a door and a door liner, the sealing assembly comprising:

a bellows gasket adapted to form a seal between the door and the cabinet; and a plastic structural shape joined with the bellows gasket and adapted to be held to the door liner, the structural shape including a channel defined by a base and a pair of walls which extend from the base; and an elastically yieldable lateral flange extending from the base and acting as a spring clip, the flange adapted to hold the structural shape to the door liner;

wherein the base is adapted to overlie the door and the door liner along a joining line which joins the door and the door liner;

wherein the structural shape is extruded from a first material, and the bellows gasket is extruded from a second material having a different rigidity than the first material; and wherein the walls of the structural shape extend to a distance from the joining line which is greater than one half of a distance from the joining line to a door liner outer edge.

2. A sealing assembly as claimed in claim 1, wherein the walls of said pair are both oblique in parallel directions.

3. A sealing assembly as claimed in claim 1, wherein the walls of said pair are oblique in diverging directions.

4. A sealing assembly as claimed in claim 1, wherein at least one wall of said pair is vertical and not inclined.

5. A sealing assembly as claimed in claim 4, wherein both walls are vertical.

6. A sealing assembly as claimed in claim 1, wherein the first material is substantially rigid, and a spring clip fulcrum of the flange includes an insert comprising substantially soft material, the insert being positioned along the flange immediately above an elbow of the flange.

7. A sealing assembly as claimed in claim 6, wherein when the flange is in a non-operative rest position, the insert has a rectilinear structure.

8. A sealing assembly as claimed in claim 1, wherein the gasket is co-extruded with the structural shape and overlies the structural shape along a length of one of the pair of walls, and overlies an external portion of the base.

9. A sealing assembly as claimed in claim 1, wherein the base comprises a first section, and a second section coplanar with the first section.

10. A sealing assembly as claimed in claim 1, wherein the base comprises a first section having a first plane and a second section having a second plane, and wherein the first and second planes are offset from one another.

11. A sealing assembly as claimed in claim 1, wherein at least one wall of said pair is inclined.

12. A sealing assembly as claimed in claim 1, wherein a portion of a replacement bellows gasket is received in the channel.

13. A sealing assembly for a refrigerator cabinet having a door and a door liner, the sealing assembly comprising:

a bellows gasket adapted to form a seal between the door and the cabinet; and a plastic structural shape joined with the bellows gasket and adapted to be held to the door liner, the structural shape including a channel defined by a base and a pair of walls each wall extending one of vertically or obliquely from the base; and an elastically yieldable lateral flange extending from the base and acting as a spring clip, the flange adapted to hold the structural shape to the door liner;

wherein the base is adapted to overlie the door and the door liner along a joining line which joins the door and the door liner;

wherein the structural shape is extruded from a first material, and the bellows gasket is extruded from a second material having a different rigidity than the first material; and wherein the walls of the structural shape extend to a distance from the joining line which is greater than one half of a distance from the joining line to a door liner outer edge.

* * * * *